US005370266A

United States Patent [19]

Woodruff

[11] Patent Number: 5,370,266

[45] Date of Patent: Dec. 6, 1994

[54] METHOD FOR REDUCING SPILLAGE WHEN POURING LIQUID OUT OF A CONTAINER

[76] Inventor: James M. Woodruff, #101 9216-93A Street, Fort St. John, British Columbia, Canada, V1J 5M6

[21] Appl. No.: 130,381

[22] Filed: Oct. 1, 1993

[51] Int. Cl.[5] ..... B65D 37/00

[52] U.S. Cl. ..... 222/1; 222/212; 222/495; 222/559; 215/266

[58] Field of Search ..... 222/1, 51, 206, 212, 222/491, 495, 544, 559; 215/266, 312, 264, 267, 209, 210; 220/666

[56] References Cited

U.S. PATENT DOCUMENTS

| | | | |
|---|---|---|---|
| 41,067 | 1/1864 | Hamilton | 222/51 X |
| 2,099,629 | 11/1937 | Schaetzel | 222/544 X |
| 2,317,626 | 4/1943 | Marino et al. | 215/266 |
| 3,138,278 | 6/1964 | Butts | 215/266 X |
| 3,194,439 | 7/1965 | Beduerftig | 222/66 |
| 4,741,448 | 5/1988 | Alley et al. | 215/266 |
| 4,789,082 | 12/1988 | Sampson | 222/491 X |
| 5,000,353 | 3/1991 | Kastanecki et al. | 222/212 X |

FOREIGN PATENT DOCUMENTS 2294919 7/1976 France .

*Primary Examiner*—Andres Kashnikow
*Assistant Examiner*—Anthoula Pomrening
*Attorney, Agent, or Firm*—Anthony R. Lambert

[57] ABSTRACT

A method of reducing spillage when pouring liquid out of a container which includes the following steps. Firstly, place a free floating buoyant member into a resilient deformable container adapted for containing liquid. The liquid must be of greater density than the density of the member such that the member floats upon the surface of the liquid. The container has a fluid flow passage narrower than the dimensions of the member such that the member is prevented from exiting through the fluid flow passage. Secondly, exert a force to temporarily deform the container thereby reducing the volume of the inner cavity and causing the liquid in the container to press the member into a position sealing the fluid flow passage. Thirdly, invert the container thereby placing the container into a pouring position. Fourthly, release the force upon the container such that the container resiliently resumes its original shape thereby increasing the volume of the inner cavity and permitting the member to float away from the fluid flow passage such that liquid freely passes through the fluid flow passage.

6 Claims, 12 Drawing Sheets

METHOD FOR REDUCING SPILLAGE WHEN POURING LIQUID OUT OF A CONTAINER

The present invention relates to a method for reducing spillage when pouring liquid out of a container.

BACKGROUND OF THE INVENTION

A variety of liquids are packaged for use in containers which are intended to be inverted to pour the contents into another container where they are ultimately consumed. One common example is motor oil. In order to add motor oil to an engine, the container filled with oil must be aligned with an oil receiving opening provided in the engine for that purpose. In the process of inverting a full container of oil it is common for a portion of the contents to be spilled over the engine and onto the ground. It is undesirable to spill an environmental pollutant liquid, such as oil. However, even when the liquid is not a pollutant it is desirable to avoid spilling liquid for reasons of a cleanliness and convenience.

SUMMARY OF THE INVENTION

What is required is a method for reducing spillage when pouring liquid out of a container.

According to one aspect of the present invention there is provided a method of reducing spillage when pouring liquid out of a container which includes the following steps. Firstly, place a free floating buoyant member into a resilient deformable container adapted for containing liquid. The liquid must be of greater density than the density the member such that the member floats upon the surface of the liquid. The container has a fluid flow passage narrower than the dimensions of the member such that the member is prevented from exiting through the fluid flow passage. Secondly, exert a force to temporarily deform the container thereby reducing the volume of the inner cavity and causing the liquid in the container to press the member into a position sealing the fluid flow passage. Thirdly, invert the container thereby placing the container into a pouring position. Fourthly, release the force upon the container such that the container resiliently resumes its original shape thereby increasing the volume of the inner cavity and permitting the member to float away from the fluid flow passage such that liquid freely passes through the fluid flow passage.

It is preferred that a round ball be used as the buoyant member, as other shapes can present difficulties in seating in a sealing position. When the described method is used, the ball seals the fluid flow passage to prevent liquid from exiting the container, as the container is inverted. Once the container is inverted and the radial inward pressure on the sidewalls of the container is released, the ball floats out of a sealing position allowing liquid to flow.

Although beneficial results may be obtained through the use of the method, as described, the container can be specifically manufactured to enhance the movement of the ball into a sealing position upon the sidewalls of the container being deformed. Even more beneficial results may, therefore, be obtained when the resilient deformable body has a pair of opposed concave sidewalls, such that the ball is positionable blocking the fluid flow passage by exerting a radial inward force upon the concave sidewalls.

It has been found that the use of concave sidewalls enhances the ability to deform the container in a manner which leads the buoyant free floating ball to move into the desired sealing position.

Although beneficial results may be obtained through the use of the method, as described, pressure locks occasionally occur. When a pressure lock occurs the ball is held in position by the liquid and friction and is not released from its sealing position as desired. Even more beneficial results may therefore, be obtained when the resilient deformable body has a first pair of concave sidewalls and a second pair of convex sidewalls. In the event of a pressure lock occurring which holds the ball in position sealing the fluid flow passage, the ball is releasable from the fluid flow passage by exerting a radial inward force upon the convex sidewalls. A radial inward force exerted upon the convex sidewalls tends to force the first pair of sidewalls outwardly to increase the volume of the inner cavity and break the pressure lock.

According to another aspect of the present invention there is provided a container which includes a resilient deformable body having a liquid impervious inner cavity. A free floating buoyant ball is disposed within the inner cavity. A fluid flow passage communicates with the inner cavity. The fluid flow passage is smaller than a diameter of the ball, thereby confining the ball within the inner cavity.

Although beneficial results may be obtained through the use of the container, as described, even more beneficial results may be obtained when the resilient deformable body has a first pair of concave sidewalls and a second pair of convex sidewalls.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
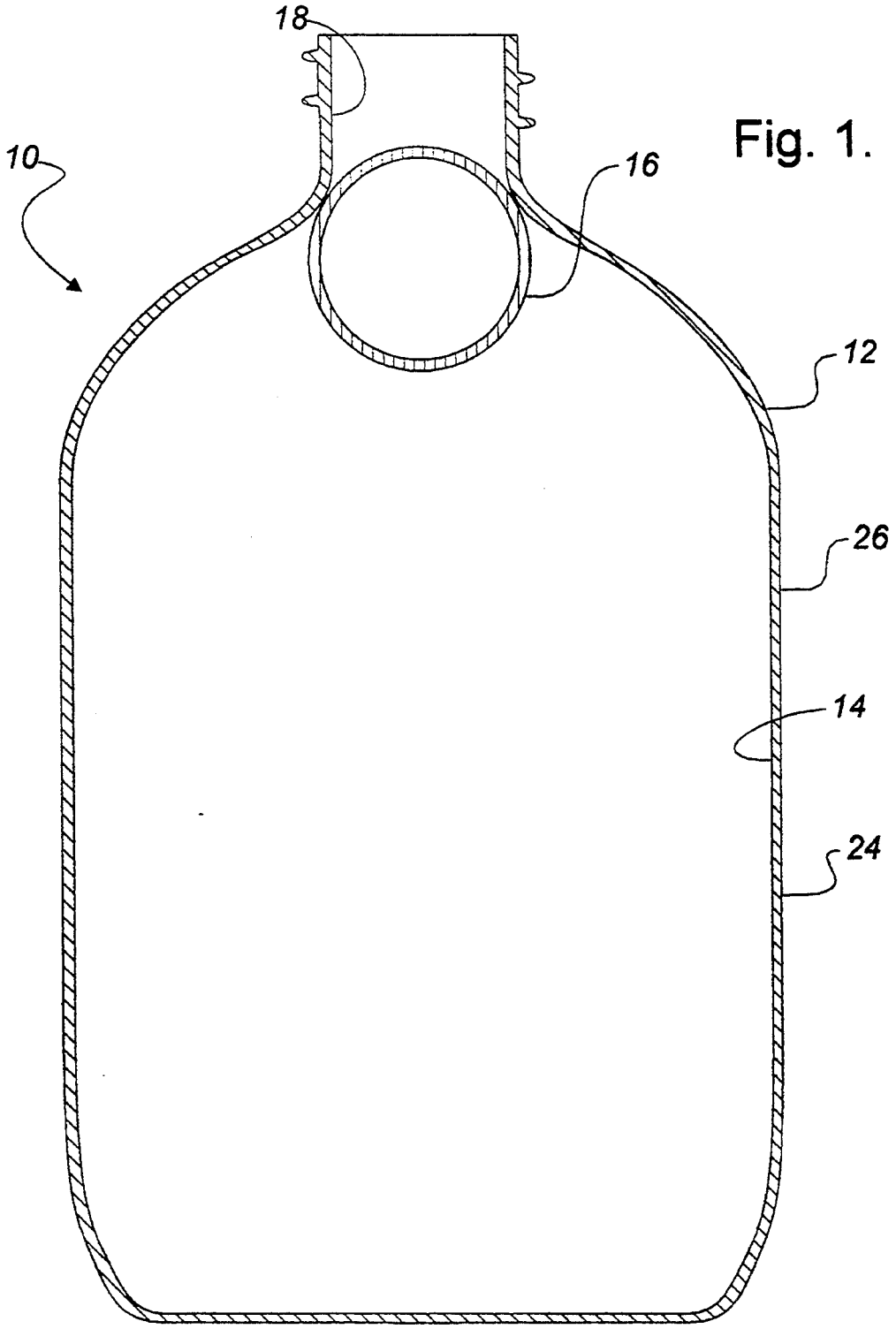
FIG. 1 is a front elevation view in longitudinal section of a container constructed in accordance with the teachings of the present invention.
Figure 2:
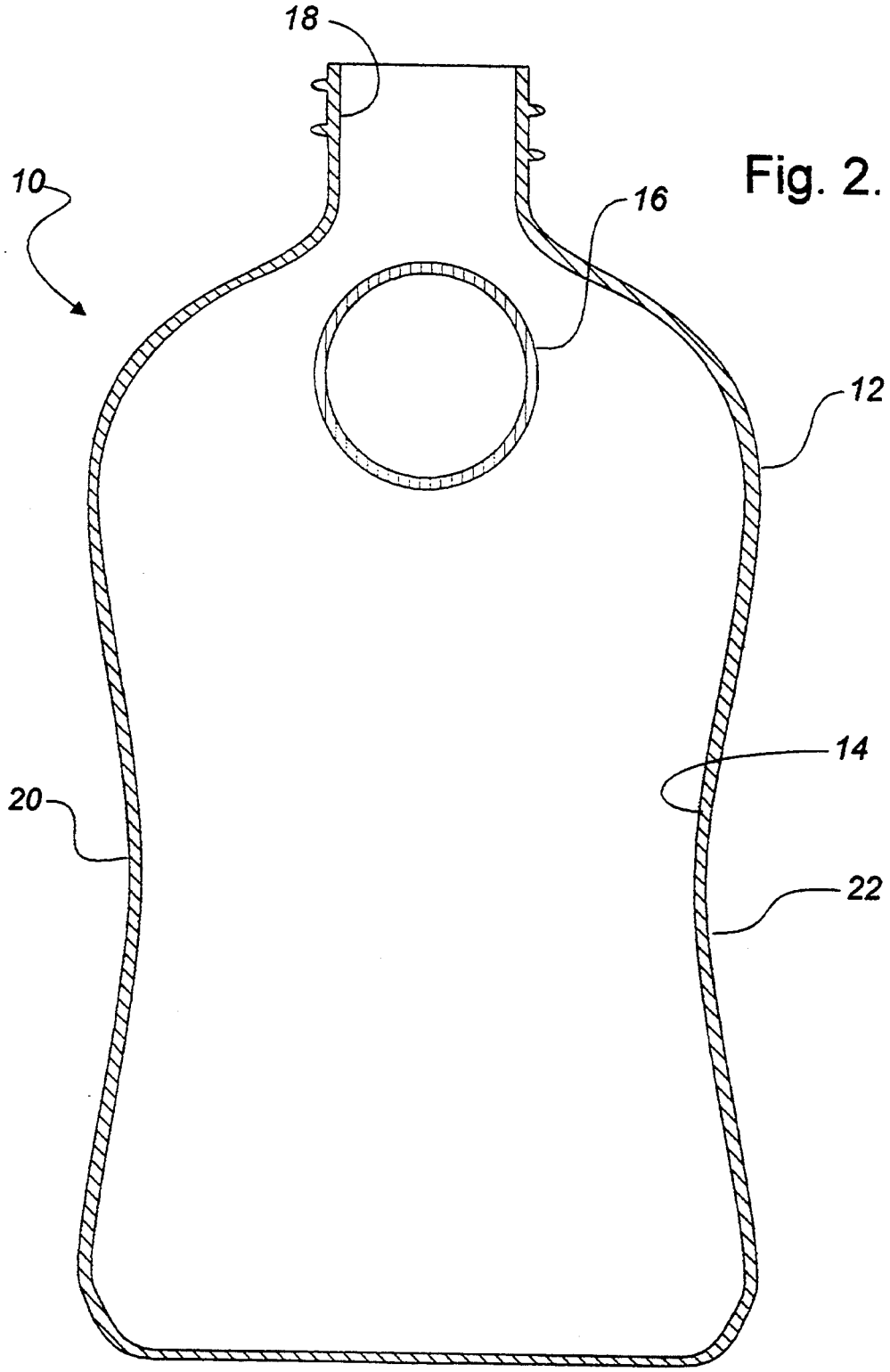
FIG. 2 is a side elevation view in longitudinal section of the container illustrated in FIG. 1.
Figure 3:
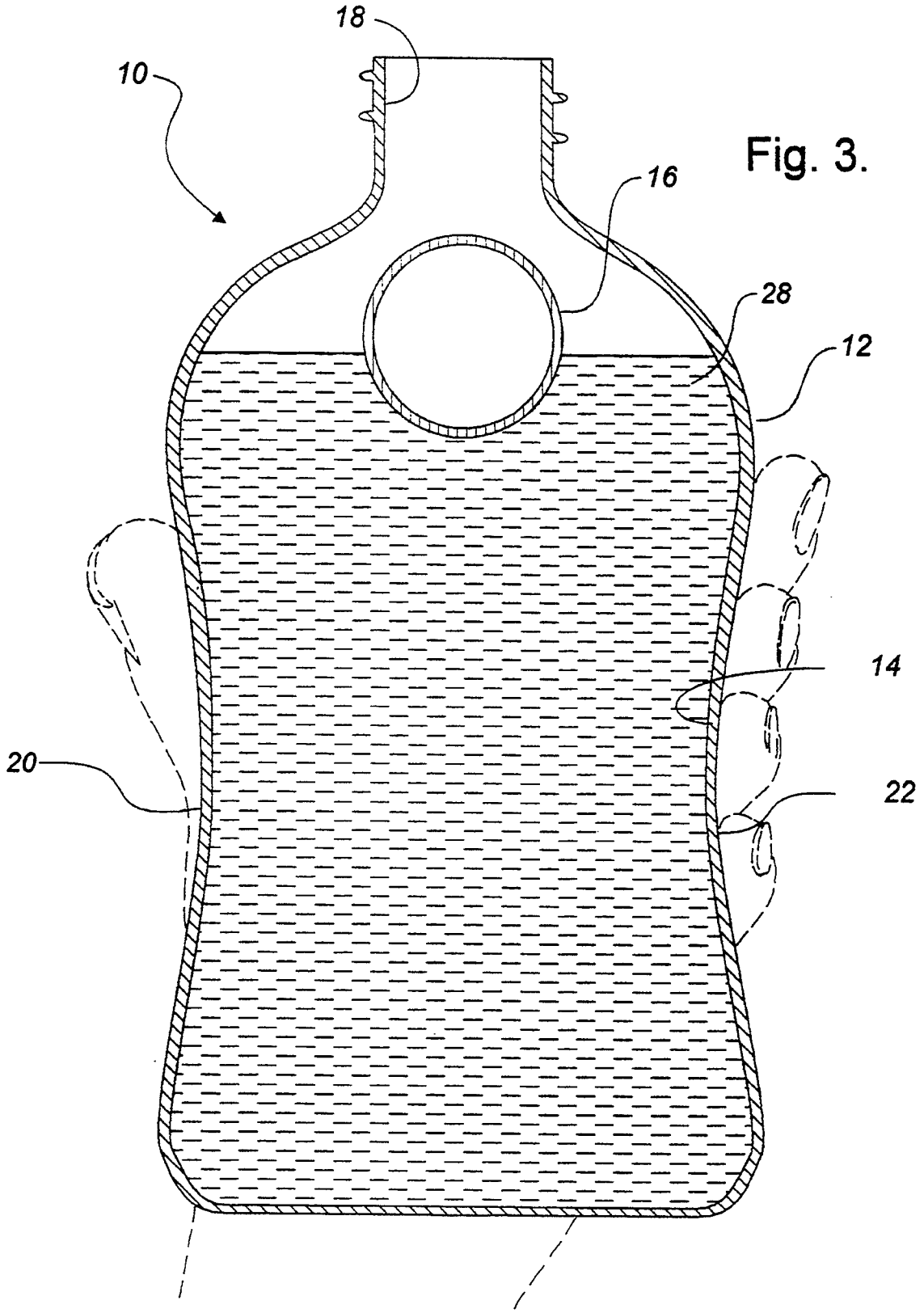
FIG. 3 is a side elevation view in longitudinal section of the container illustrated in FIG. 1, filled with liquid in accordance with the teachings of the method.
Figure 4:
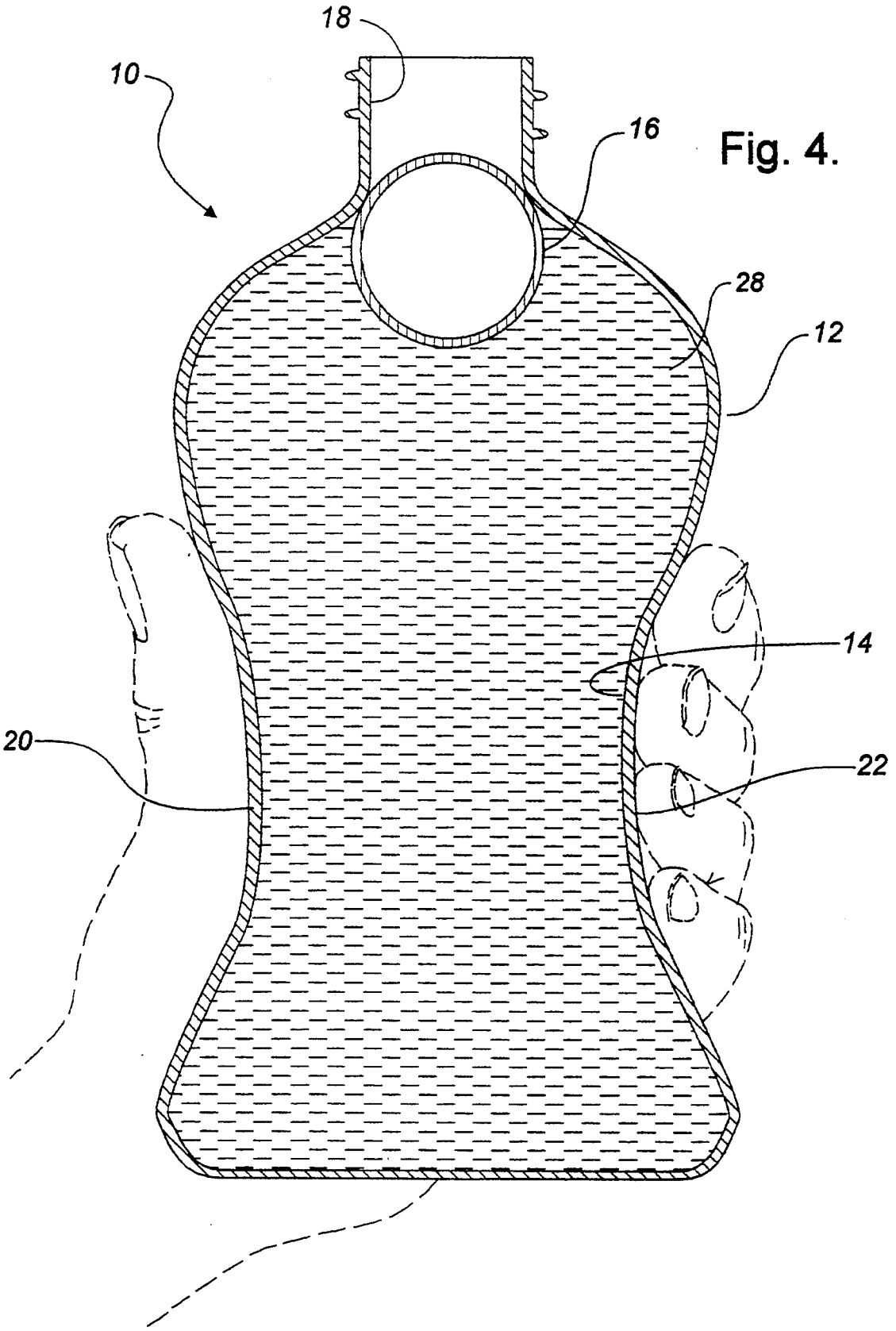
FIG. 4 is a side elevation view in longitudinal section of the container illustrated in FIG. 1, with an inward radial force being exerted in accordance with the teachings of the method.
Figure 5:
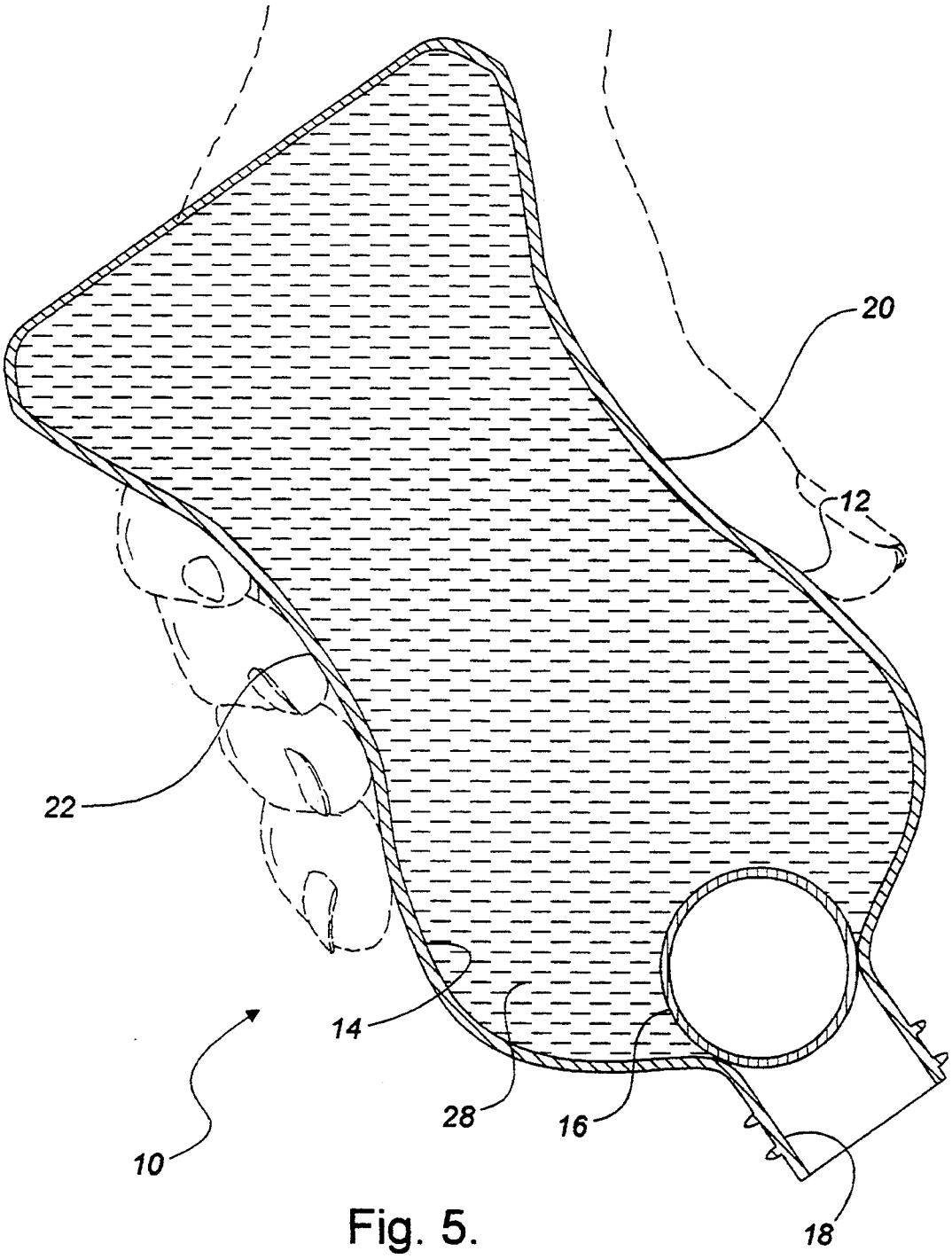
FIG. 5 is a side elevation view in longitudinal section of the container illustrated in FIG. 1, inverted in accordance with the teachings of the method.
Figure 6:
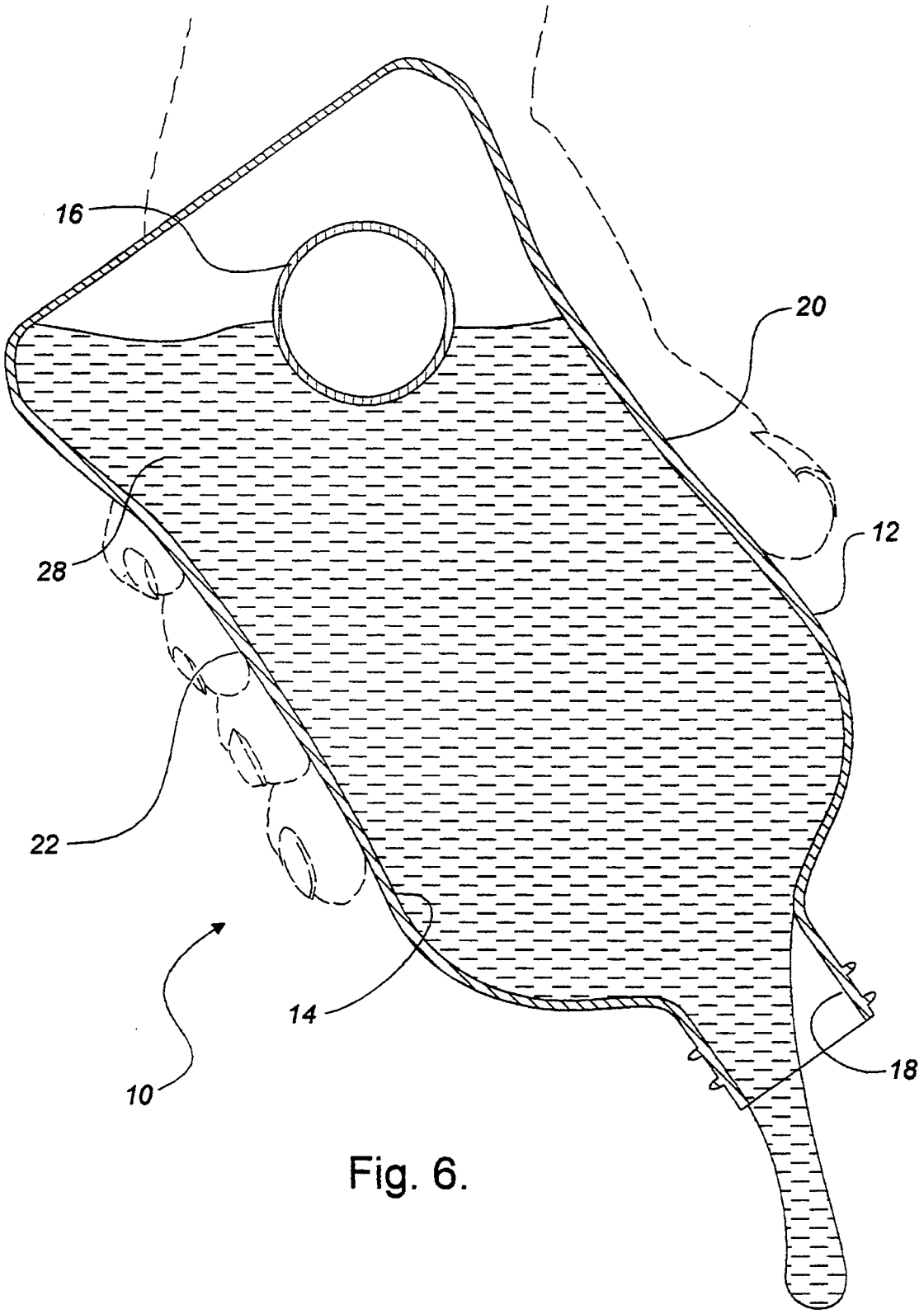
FIG. 6 is a side elevation view in longitudinal section of the container illustrated in FIG. 1, with liquid flowing.

The method will hereinafter be described with reference to the preferred embodiment, a container for liquid generally identified by reference numeral 10. The container is illustrated in FIGS. 1, 2 and 9. The method is described in FIGS. 3 through 8.

Referring to FIGS. 1 and 2, container 10 has a resilient deformable body 12. It is envisaged that body 12 would be manufactured from a polymer material, although there are other materials having suitable properties which are liquid impervious. Body 12 has an inner cavity 14. A buoyant member, in the form of ball 16, is disposed within inner cavity 14. It must be emphasized that ball 16 must be free floating or it will create problems in using container 10 in accordance with the preferred method. A annular fluid flow passage 18 communicates with inner cavity 14. Fluid flow passage 18 is smaller in diameter than ball 16, in order to ensure that ball 16 is confined within inner cavity 14. There are a number of ways of placing ball 16 within inner cavity 14. Ball 16 can be deformable and forced under pressure through fluid flow passage 18 after fabrication of body 12, or ball 16 can be inserted as part of the fabrication process. Referring to FIG. 9, it is preferred that body 12 have a first pair of generally concave sidewalls 20 and 22, and a second pair of generally convex sidewalls 24 and 26.

The use of container 10 in accordance with the preferred method will now be described with reference to FIGS. 3 through 8. Firstly, referring to FIG. 3, buoyant ball 16 is placed into resilient deformable body 12 of container 10 adapted for containing liquid, generally indicated by reference numeral 28. Liquid 28 should be of greater density than the density ball 16 such that ball 16 floats upon the surface of liquid 28. As previously stated, fluid flow passage 18 of container 10 is narrower in diameter than ball 16 such that ball 16 is prevented from exiting container 10 via fluid flow passage 18. Secondly, referring to FIG. 4, exert a radially inward force upon sidewalls 20 and 22 of container 10 to temporarily deform container 10. When this is done the volume of inner cavity 14 is decreased. With the decrease in volume of inner cavity 14, air is expelled from container 10 and liquid 28 presses floating ball 16 into a position sealing fluid flow passage 18. Thirdly, referring to FIG. 5, invert container 10 thereby placing container 10 into a pouring position. It should be noted that the positioning of ball 16 prevents liquid 28 from flowing through fluid flow passage 18. Pressure must be maintained upon sidewalls 20 and 22 during throughout this step. Fourthly, referring to FIG. 6, release the force upon sidewalls 20 and 22 of container such 10. Container 10 resiliently resumes its original shape thereby increasing the volume of inner cavity 14. The resilient movement breaks the seal allowing an inflow of air into inner cavity 14 that accompanies the change in volume. The forces maintaining ball 16 in the sealing position are friction with fluid flow passage 18 and the weight of the column of liquid 28. The resilient movement of container 10 and the entry of air will, in most instances, exert sufficient force counterbalance the forces maintaining ball 16 in the sealing position. Once the forces are counterbalanced ball 16 will float away from fluid flow passage 18 enabling liquid 28 to freely pass through fluid flow passage 28.

In use as described, ball 16 seals fluid flow passage 18 to prevent liquid 28 from exiting container 10, as container 10 is inverted. Once container 10 has been inverted and the radial inward pressure on sidewalls 20 and 22 of container 10 is released, ball 16 floats out of the position sealing fluid flow passage 18 thereby allowing liquid to flow. The key to the method is the manner in which the volume of inner cavity 14 can be altered by manipulation of the sidewalls. Radial inward pressure upon concave sidewalls 20 and 22 deforms container 10 reducing the volume of inner cavity 14, causing liquid 28 to lift ball 16 into the sealing position.

Figure 7:
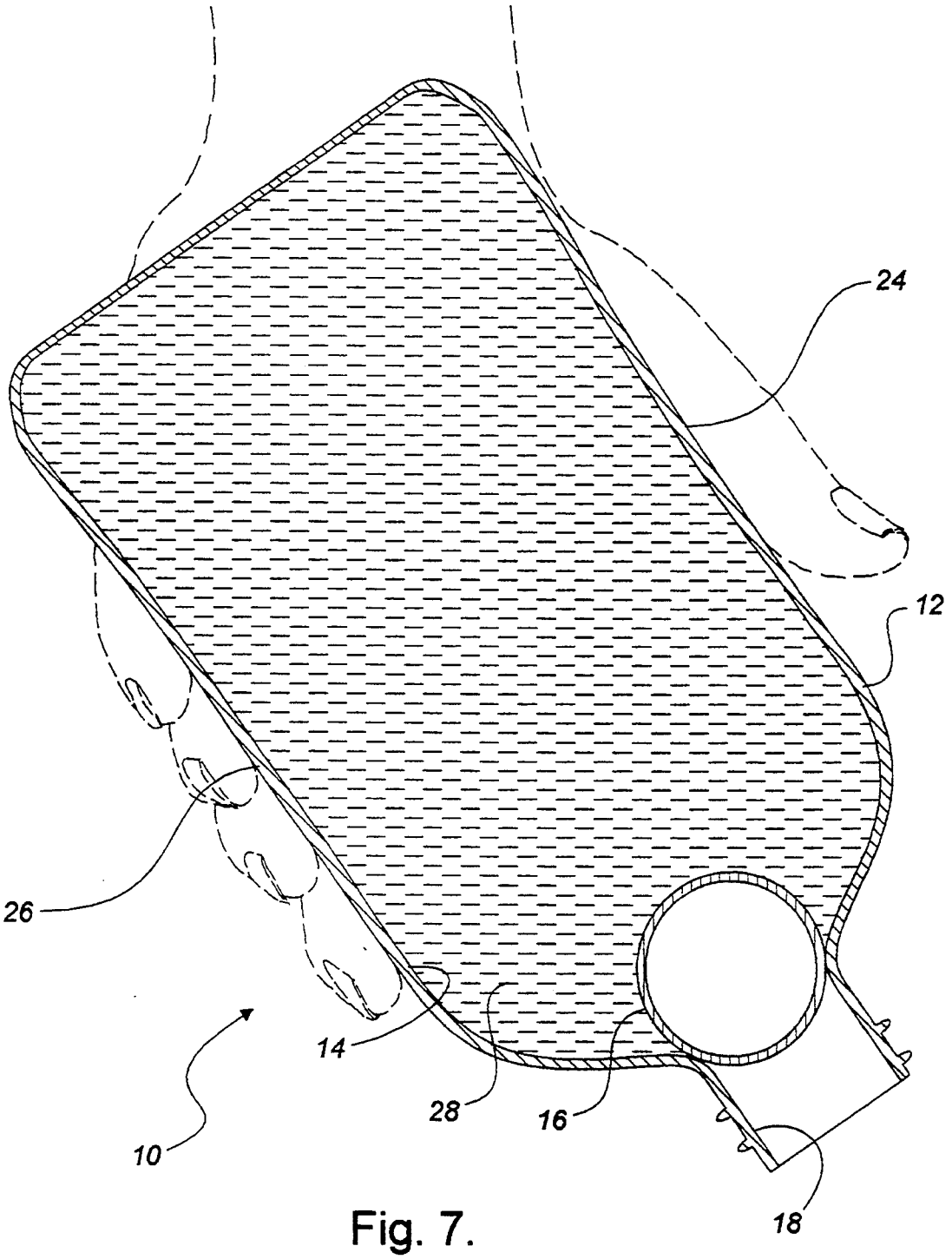
FIG. 7 is a front elevation view in longitudinal section of the container illustrated in FIG. 1, in which a pressure lock condition exists.
Figure 8:
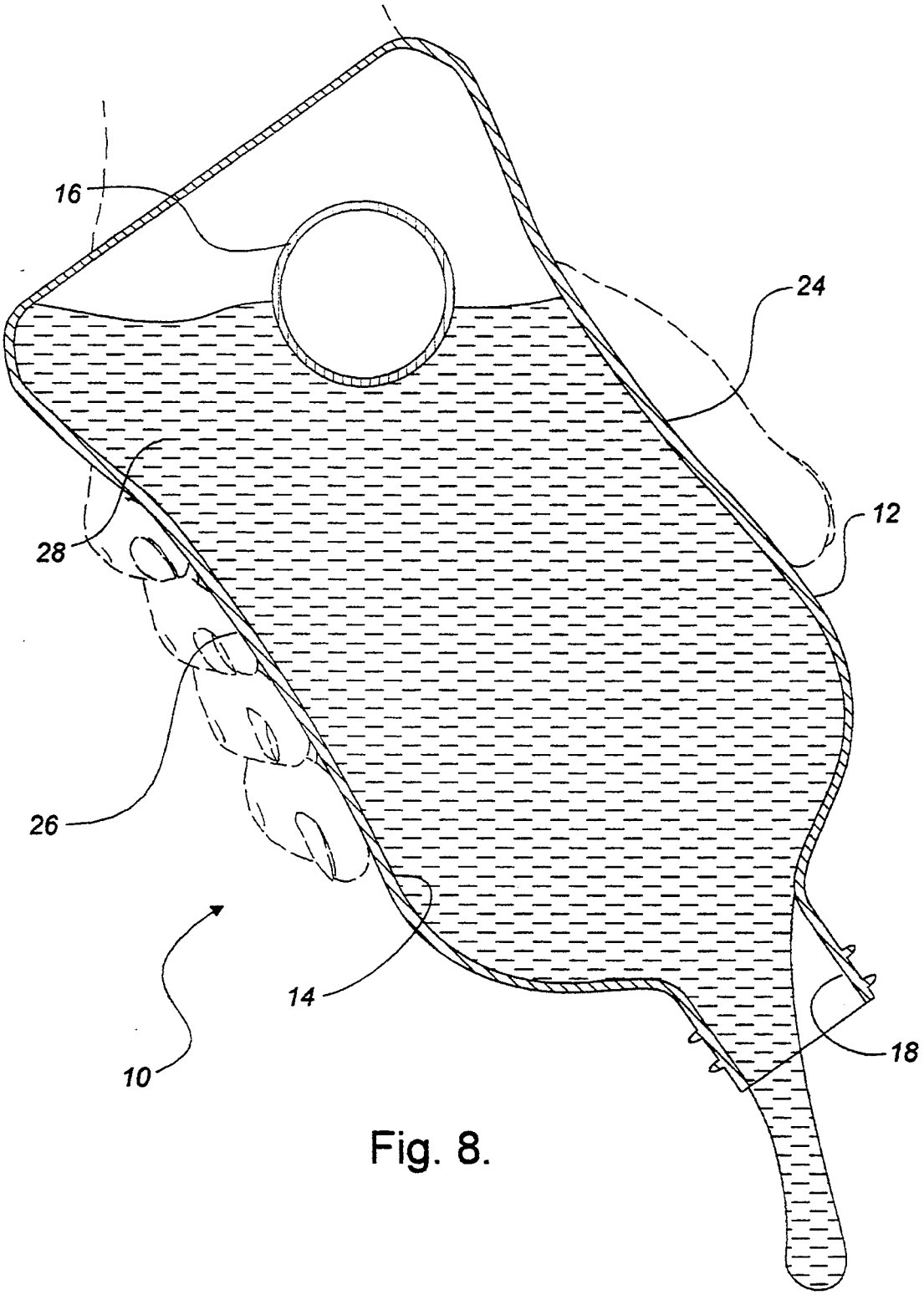
FIG. 8 is a front elevation view in longitudinal section of the container illustrated in FIG. 7, with an inward radial force being exerted in accordance with the teachings of the method to get liquid flowing.
Figure 9:
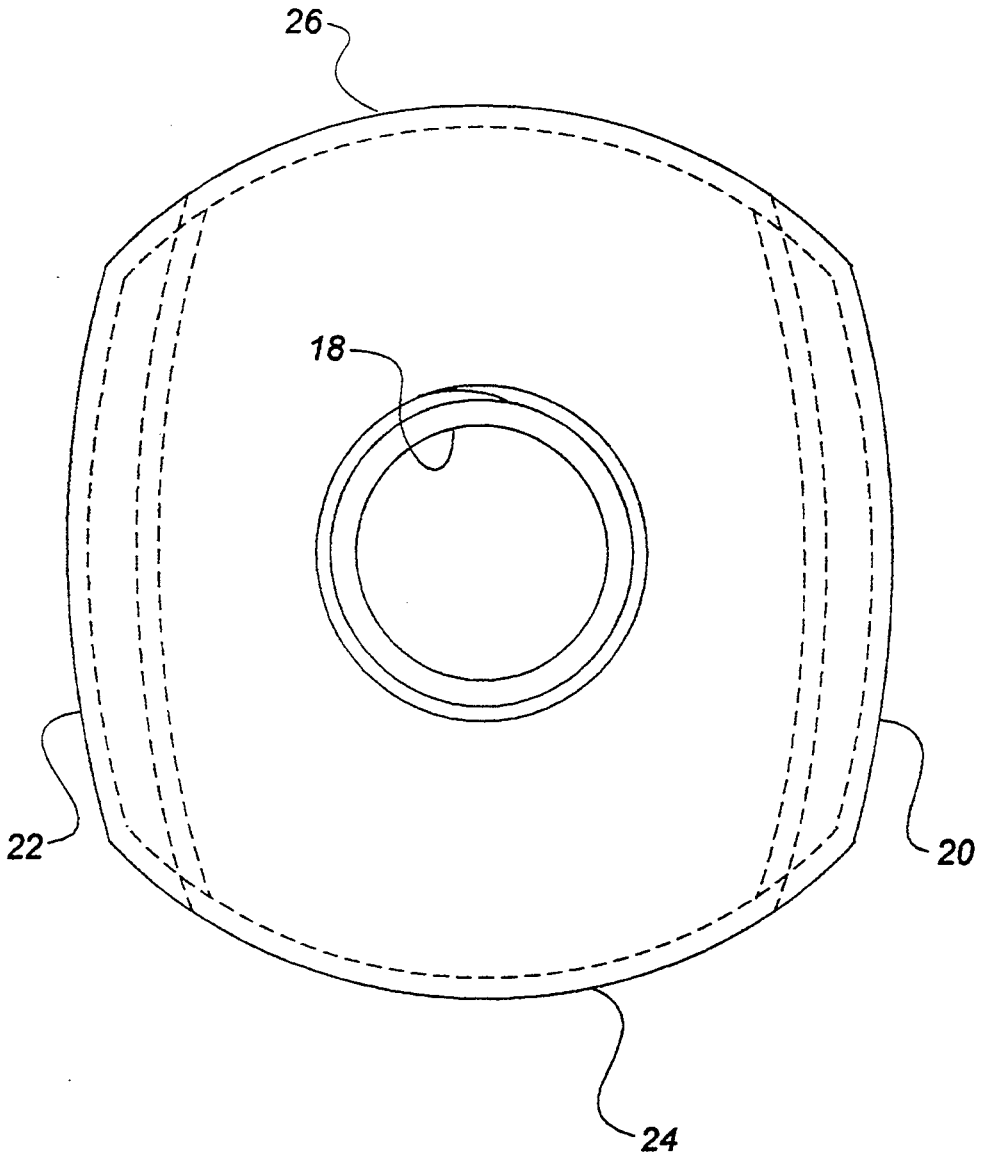
FIG. 9 is a top plan view of the container illustrated in FIG. 1.

FIGS. 7 and 8, illustrates steps which can be taken if a pressure lock occurs, that is, if the resilient movement of container 10 when radial inward pressure upon sidewalls 20 and 22 is released is not sufficient to break the seal to permit an inflow of air. When this type of "pressure lock" occurs a differential in pressure retains ball 16 in position sealing fluid flow passage 18. Ball 16 is releasable from fluid flow passage 18 by exerting a radial inward force upon second pair of sidewalls 24 and 26. The radial inward force exerted upon second pair of sidewalls 24 and 26 tends to force first pair of sidewalls 20 and 22 outwardly to break the pressure lock. Radial inward pressure upon convex sidewalls 24 and 26 deforms container 10, causing a counter pressure of incoming air that assists in releasing ball 16 from its sealing position.

Figure 10:
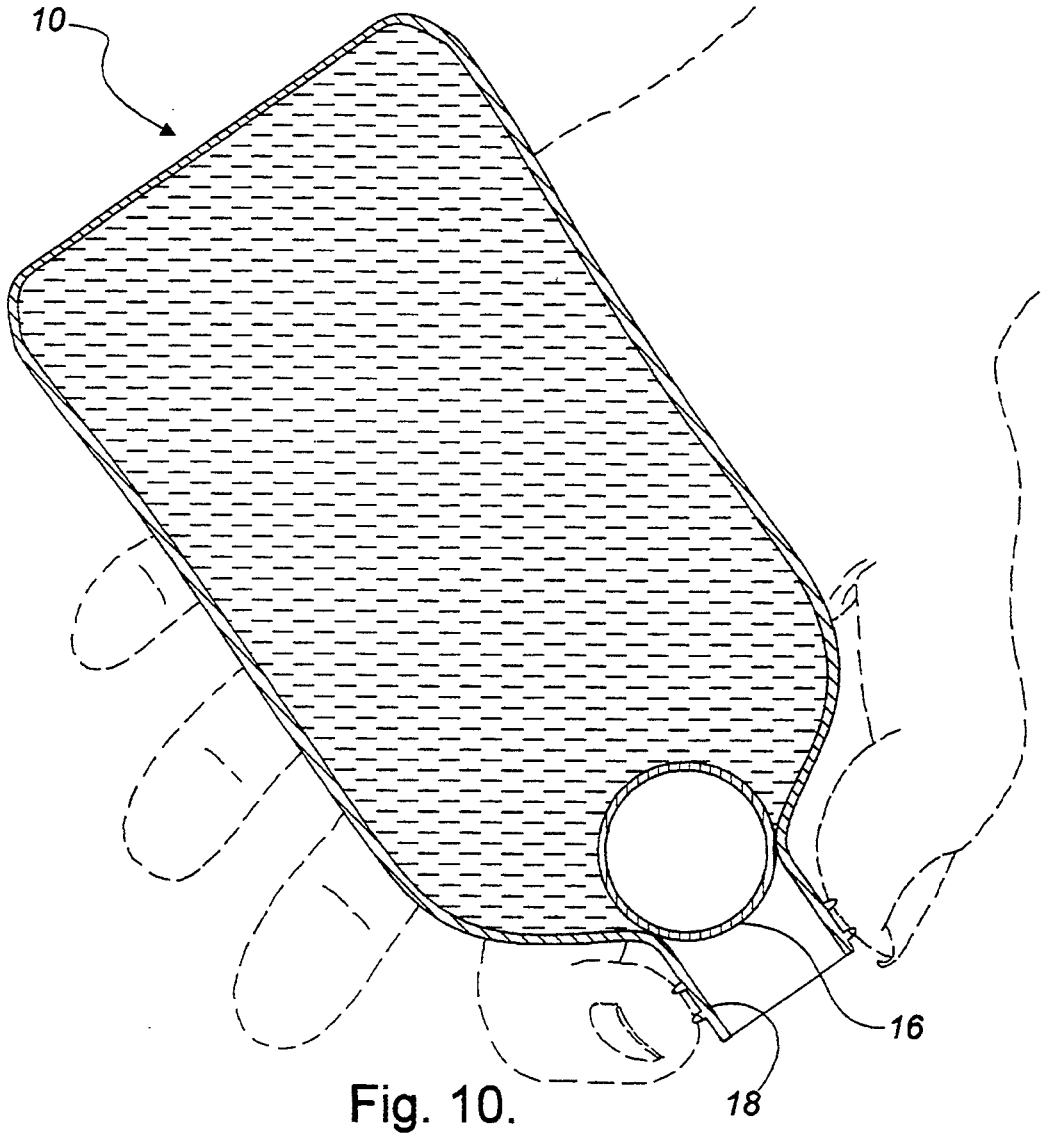
FIG. 10 is a front elevation view in longitudinal section of the container illustrated in FIG. 1, in which a pressure lock condition exists.
Figure 11:
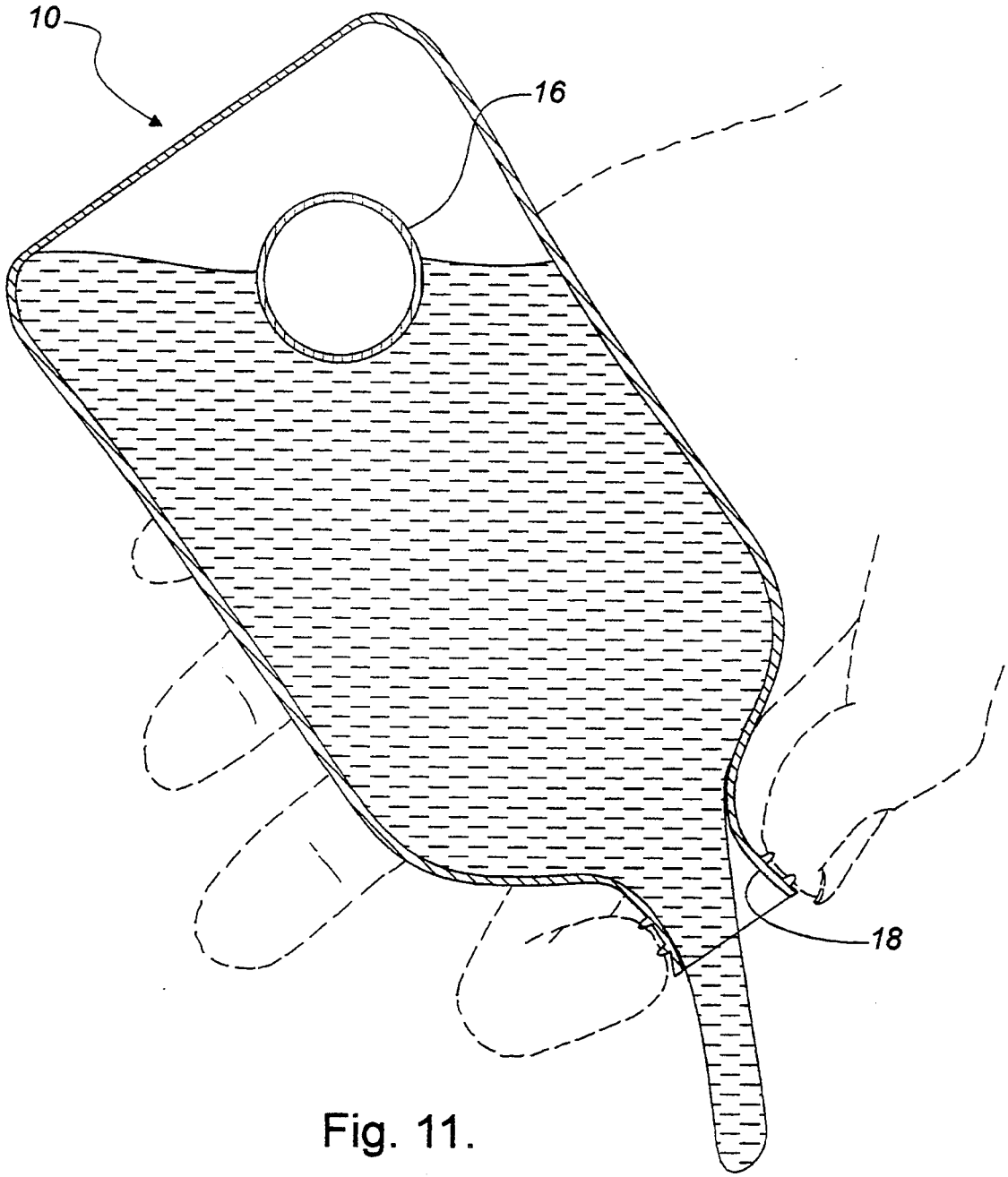
FIG. 11 is a front elevation view in longitudinal section of the container illustrated in FIG. 10, with the fluid flow passage deformed to break the pressure lock condition.
Figure 12:
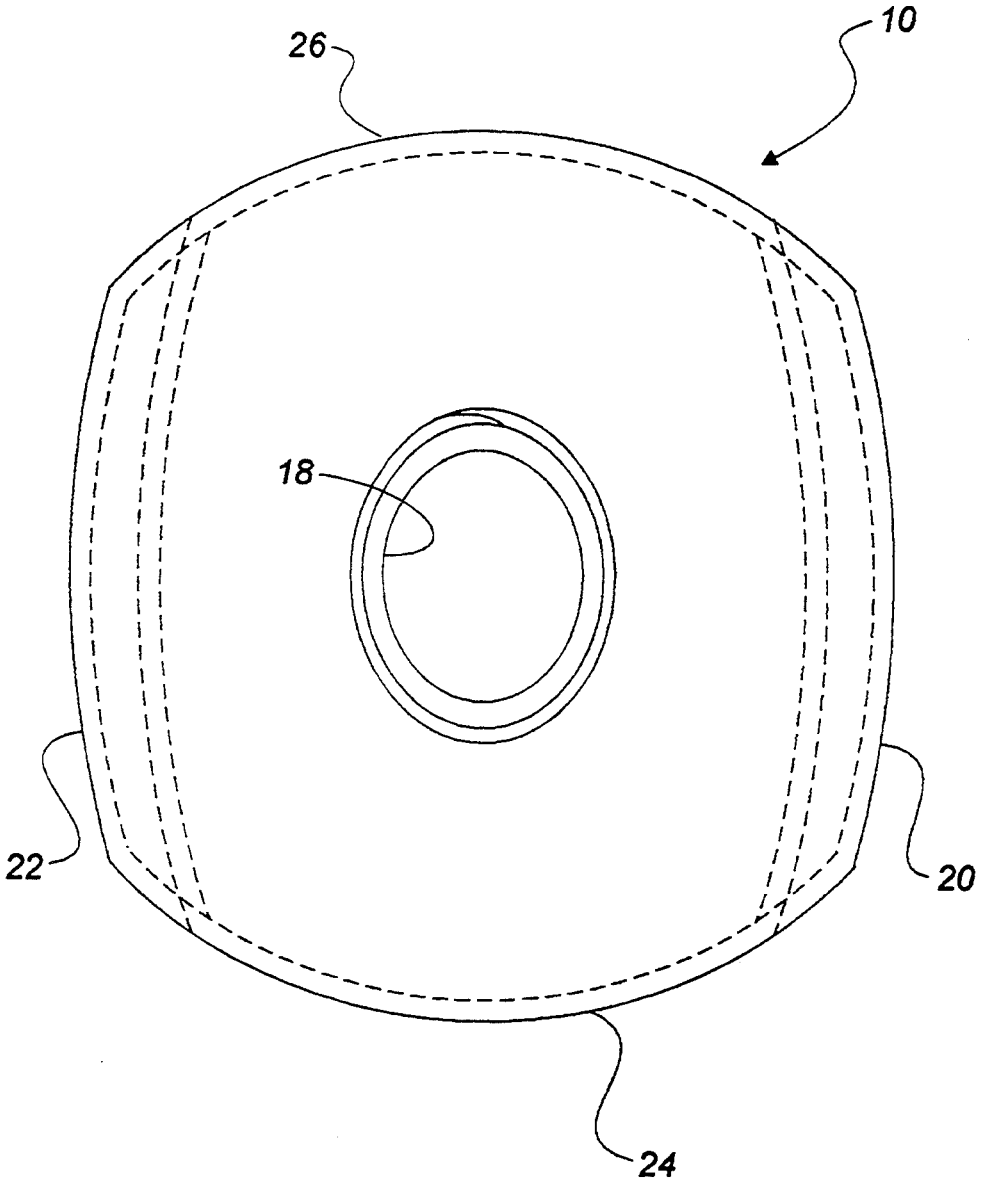
FIG. 12 is a top plan view of the container illustrated in FIG. 11, with the fluid flow passage deformed.

If fluid flow passage 18 deforms a seal will not be maintained with ball 16. Therefore, if fluid flow passage 18 is deformable, this will provide an alternative means of breaking a pressure lock. This alternative is illustrated in FIGS. 10 through 12. FIG. 10 illustrates container 10 in which a pressure lock condition exists. FIG. 11 illustrates the manner in which one would deform fluid flow passage 18 in order to release the pressure lock condition. FIG. 12 illustrates the appearance that normally circular fluid flow passage 18 assumes when deformed. When fluid flow passage 18 is deformed, the seal is broken permitting the pressure outside the container to balance the pressure within inner cavity 14. Once the pressures are balanced the buoyancy of ball 16 causes it to float away from the sealing position. Once ball 16 is removed from the sealing position liquid flows through fluid flow passage 18.

A few cautionary notes must be raised as to matters that can effect the operation of the invention. The described method is not suited for use with carbonated beverages, as the carbonation creates increased pressures that are difficult to overcome. The operation of the method is effected to some degree upon the viscosity of the liquid. The more viscose the liquid the closer the tolerances must be to effectively seal the container. The efficient operation of the method is dependent upon by the amount of liquid 28 in container 10. When container 10 is nearly empty there is not sufficient liquid to lift ball 16 into the sealing position. The efficient operation of the method requires pressure to be maintained until container 10 is in position, premature release of pressure, whether due to accidental bumping or carelessness, will result in spillage. Of course, if container 10 has a plurality of fluid flow passages 18, all fluid flow passages must be closed. It is not possible to build up the required pressure within container 10 to maintain ball 16 in a sealing position, if one of fluid flow passages 18 is opened to allow pressure to escape.

By following the teachings of the present invention a container 10 can be made out of a lighter grade of polymer plastic than would otherwise be possible. Normally a container which is made from a lighter grade of polymer plastic is too flexible; that is, it lacks the rigidity necessary to align the container without the possibility of spillage. In accordance with the teachings of the present method, container 10 is "pressurized" throughout the alignment step. Pressurization provides an otherwise flexible container made of lighter grade polymer plastic with the necessary rigidity.

It will be apparent to one skilled in the art that by following the teachings of the present invention it is possible to more readily invert and pour liquid from a container without risk of spilling the same. It will also be apparent to one skilled in the art that modifications may be made to the illustrated embodiment without departing from the spirit and scope of the invention as defined by the Claims.

The embodiments of the invention in which an exclusive property or privilege is claimed are as follows:

1. A method of reducing spillage when pouring, liquid out of a container, comprising the following steps:
   a. firstly, placing a free floating buoyant member into a resilient deformable container adapted for containing liquid, the liquid being of greater density than the density of the member such that the member floats upon the surface of the liquid, the container having a fluid flow passage narrower than the dimensions of the member such that the member is prevented from exiting through the fluid flow passage;
   b. secondly, exerting a force to temporarily deform the container thereby reducing the volume of the inner cavity and causing the liquid in the container to press the member into a position sealing the fluid flow passage;
   c. thirdly, inverting the container thereby placing the container into a pouring position; and
   d. fourthly, releasing the force upon the container such that the container resiliently resumes its original shape thereby increasing the volume of the inner cavity and permitting the member to float away from the fluid flow passage such that liquid freely passes through the fluid flow passage.

2. The method as defined in claim 1, the buoyant member being a ball.

3. The method as defined in claim 1, the resilient deformable container having a first pair of opposed concave sidewalls, such that the member is positionable blocking the fluid flow passage by exerting a radial inward force upon the concave sidewalls.

4. The method as defined in claim 3, the resilient deformable container having a second pair of convex sidewalls, such that in the event of a pressure lock occurring which holds the member in position blocking the fluid flow passage, the member is releasable from the fluid flow passage by exerting a radial inward force upon the second pair of sidewalls, thereby deforming the container to force the concave sidewalls outwardly, thus permitting the member to float away from the fluid flow passage such that liquid freely passes through the fluid flow passage.

5. The method as defined in claim 1, the fluid flow passage being deformable, such that in the event of a pressure lock occurring which holds the member in position blocking the fluid flow passage, the member is releasable from the fluid flow passage by exerting a radial inward force upon the fluid flow passage, thereby deforming the fluid flow passage to break the seal between the member and the fluid flow passage.

6. A method of reducing spillage when pouring liquid out of a container, comprising the following steps:
   a. firstly, placing a free floating ball into a resilient deformable container adapted for containing liquid, the liquid being of greater density than the density of the ball such that the ball floats upon the surface of the liquid, the container having a first pair of opposed concave sidewalls, a second pair of opposed convex sidewalls, and a fluid flow passage narrower than the dimensions of the ball such that the ball is prevented from exiting through the fluid flow passage;
   b. secondly, exerting a radial inward force upon the concave sidewalls to temporarily deform the container thereby reducing the volume of the inner cavity and causing the liquid in the container to press the ball into a position sealing the fluid flow passage;
   c. thirdly, inverting the container thereby placing the container into a pouring position and then releasing the radial inward force upon the concave sidewalls; and
   d. fourthly, in case of pressure lock, exerting a radial inward force upon the second pair of sidewalls, thereby deforming the container to force the concave sidewalls outwardly, thus permitting the member to float away from the fluid flow passage such that liquid freely passes through the fluid flow passage.

* * * * *